US005500966A

United States Patent [19]

Wheat

[11] Patent Number: 5,500,966

[45] Date of Patent: Mar. 26, 1996

[54] ZIPPER ASSISTANCE TOOL

[76] Inventor: Alan Wheat, 18809 Egret Bay #202, Houston, Tex. 77058

[21] Appl. No.: 222,532

[22] Filed: Apr. 4, 1994

[51] Int. Cl.[6] ..... B25F 1/00; B25B 33/00

[52] U.S. Cl. ..... 7/169; 81/488

[58] Field of Search ..... 7/151, 169, 170; 81/3.55, 484, 488

[56] References Cited

U.S. PATENT DOCUMENTS

| | | | |
|---|---|---|---|
| D. 137,738 | 4/1944 | Bradley | 7/169 |
| 1,368,038 | 2/1921 | Larsen | 81/3.55 |
| 4,463,631 | 8/1984 | Barnes et al. | 7/151 |

*Primary Examiner*—Bruce M. Kisliuk

*Assistant Examiner*—Joni B. Danganan

*Attorney, Agent, or Firm*—Harrison & Egbert

[57] ABSTRACT

A tool for facilitating the movement of a zipper including a handle, an arm connected to and extending transversely to a longitudinal axis of the handle, and a zipper flap receiving area formed in the arm at an end opposite the handle. The zipper flap receiving area serves to receive a zipper flap therein. The handle is integrally connected to the arm. The arm has a top surface, a bottom surface, a first side surface, and a second side surface. The zipper flap receiving area extends into the first side surface and through the arm from the top surface to the bottom surface. The zipper flap receiving area is a slot formed in the arm having an opening in the first side surface. The arm also has a tapered surface formed at an end opposite the handle.

19 Claims, 1 Drawing Sheet

ZIPPER ASSISTANCE TOOL

TECHNICAL FIELD

The present invention relates to apparatus that assist in the manipulation of a zipper. More particularly, the present invention relates to tools that facilitate the movement of a zipper flap along a zipper. The present invention further relates to tools that are useful for opening beverage cans.

BACKGROUND ART

Zippers are commonly used on many articles of clothing, on luggage, on containers, and many other items. The zipper is used by applying a force to a flap which is hingedly connected to a slide member extending along the teeth of the zipper. By moving the slide member and the flap upwardly and downwardly, a person can open and close the zipper. Under most circumstances, this task is relatively easy and can be performed by most people.

However, there are certain circumstances where it is quite difficult for a person to properly move the zipper. For example, persons having extremely long fingernails find it very difficult to properly grasp the flap of the zipper for the purposes of opening and closing the zipper. The long fingernails often conflict with one another when it is necessary to pinch the fingers in a fashion necessary so as to properly grasp the flap. Under other circumstances, age, arthritic conditions, or other impairments can reduce a person's ability to properly manipulate a zipper. Those with arthritis often find it very difficult to manipulate their fingers for the purpose of moving a zipper. Still under other circumstances, it is extremely difficult to manipulate the zipper when the zipper must be forcibly closed. One of these circumstances is with overpacked luggage. It is often quite difficult to close the zipper (or open the zipper) when the load within the luggage is too great. A great deal of force must be applied to the zipper for the purpose of closing the luggage. A similar circumstance occurs when a person is attempting to wear undersized clothing. A variety of other circumstances exist that make it quite difficult to open and close a zipper.

Many persons also find it quite difficult to carry out the necessary manipulations to open the tab of a beverage can. Those same persons that have a difficulty in manipulating a zipper will also have problems with the opening of a beverage can. Persons with long fingernails, arthritis, muscular impairments, and inadequate strength find it virtually impossible to apply the necessary pressures for the purposes of opening the beverage can.

It is an object of the present invention to provide a tool that facilities the manipulation of a zipper.

It is another object of the present invention to provide a tool that facilities the opening of a beverage can.

It is still another object of the present invention to provide a tool that is relatively inexpensive, easy to use, and easy to manufacture.

These and other objects and advantages of the present invention will become apparent from a reading of the attached specification and appended claims.

SUMMARY OF THE INVENTION

The present invention is a tool that comprises a handle, an arm connected to and extending transverse to a longitudinal axis of the handle, and a zipper flap receiving means formed in the arm at an end opposite to the handle. The zipper flap receiving means serves to receive a zipper flap therein.

In the present invention, the handle is integrally connected to the arm. Both the arm and the handle are linear members. The arm and the handle have a generally rectangular cross-sectional area.

The arm has a top surface, a bottom surface, a first side surface, and a second side surface. The zipper flap receiving means extends into the first side surface and through the arm from the top surface to the bottom surface. The zipper flap receiving means is a slot formed in the arm. This slot has an opening in the first side surface. The opening has a width of less than one-quarter inch and greater than a thickness of the zipper flap. The slot extends into the arm for approximately one-half the width of the top surface and the bottom surface.

The arm also includes a tapered surface formed at the end opposite the handle. The tapered surface extends from the top surface to the bottom surface. The bottom surface has a greater length from the handle than the top surface. The bottom surface has a length approximately one-quarter inch longer than the top surface. The slot of the zipper flap receiving means is positioned between the tapered surface and the handle. The handle has a hole extending therethrough for the purpose of receiving a keychain.

DETAILED DESCRIPTION OF THE INVENTION

Figure 1:
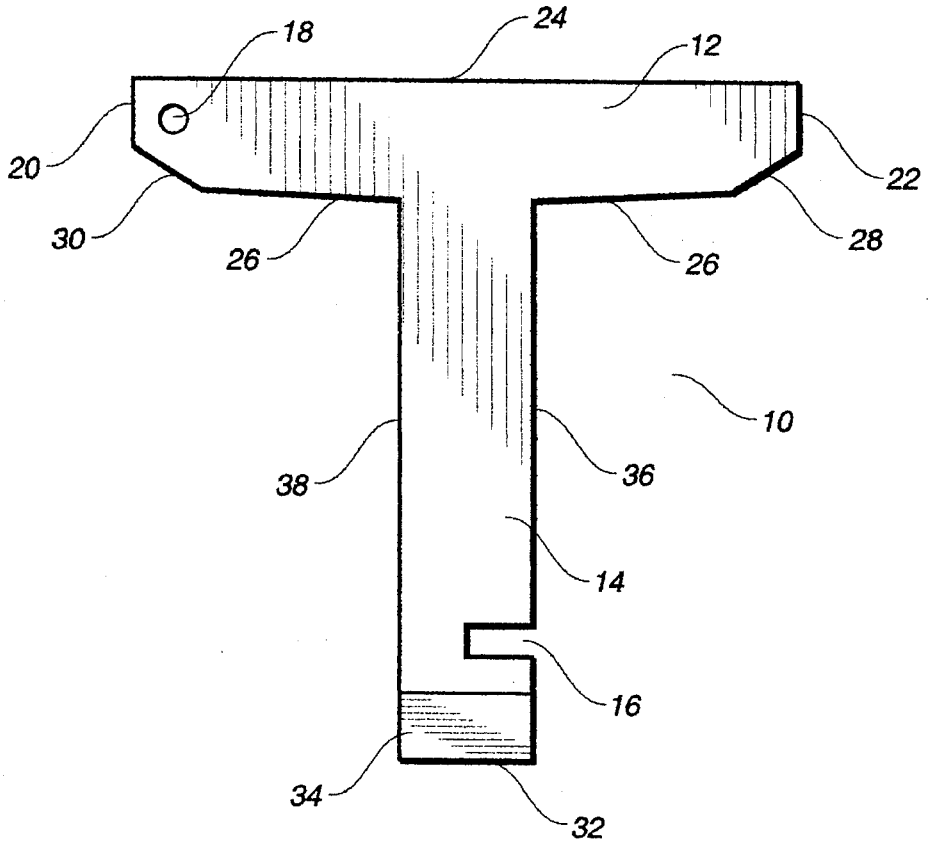
FIG. 1 is a plan view of the zipper assistance tool of the present invention.

Referring to FIG. 1, there is shown at 10 the zipper assistance tool in accordance with the preferred embodiment of the present invention. The zipper assistance tool 10 includes a handle 12, an arm 14, and a zipper flap receiving means 16. The arm 14 is connected to and extends transverse to a longitudinal axis of the handle 12. The zipper flap receiving means 16 is formed in the arm 14 at an end opposite to the handle 12. The zipper flap receiving means 16 is a slot which is suitable for receiving a zipper flap therein.

In the present invention, the handle 12 is integrally connected to the arm 14. As can be seen, the arm 12 has a hole 18 formed adjacent side 20. The hole 18 is formed in the handle 12 so as to receive a keychain, or other item, therein. The hole 18 can be used so as to facilitate the transportability of the tool 10. The handle 12 is a generally linear member extending from end 20 to end 22. The handle 12 includes a back surface 24 which is generally flat. The inner surface 26 tapers at 28 and 30 toward the ends 22 and 20, respectively. The inner surface 26 can be configured as shown in FIG. 1, or can be formed with curved indentations for accommodating the fingers of the user. The back surface 24 is flat so as to fit in conforming relationship against the knuckles, fingers, or hand of the user.

The arm 14 is also a linear member that extends in a transverse direction to the handle 12. The arm 14 has an end 32 opposite handle 12. The slot 16 is formed generally adjacent to the end 32.

In FIG. 1, it can be seen that a tapered surface 34 is formed adjacent to the end 32. As will be described in FIG. 2, the tapered surface 34 extends from the bottom surface to the top surface of the arm 14.

The arm 14 has a first side surface 36 and a second side surface 38. The slot 16 extends into the first side surface 36 for a distance approximately equal to one-half the width of the arm 14. The slot 16 has a thickness of less than one-quarter of an inch. Preferably, the slot 16 will have a width of three-sixteenths of an inch. This dimension has been chosen so as to properly accommodate the thickness of zipper flaps and also to allow for the proper leverage to be exerted by the wedging of a zipper flap within the slot 16. The slot 16 is a generally rectangular slot that extends into arm 14 a suitable distance so as to accommodate the widths of conventional zipper flaps.

Figure 2:
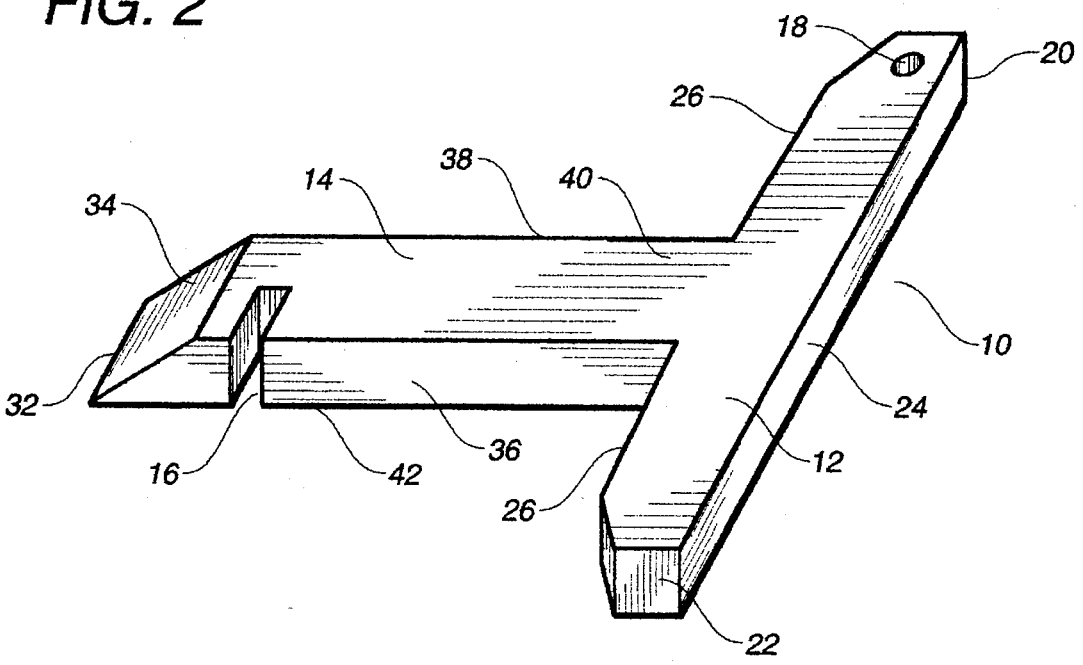
FIG. 2 is a perspective view of the zipper assistance tool of the present invention.

The configuration of the slot 16, in relation to the arm 14, can be better seen by the illustration of the zipper assistance tool of FIG. 2. As can be seen in FIG. 2, the arm 14 has a top surface 40, a bottom surface 42, a first side surface 36 and a second side surface 38. The slot 16 opens into the first side surface 36 and extends from the top surface 40 to the bottom surface 42. So as to facilitate the manufacture of the present invention, the slot 16 has the same width at the top surface 40 as it has at the bottom surface 42. The slot 16 extends into the arm 14 for approximately one-half the width of the top surface 40 and the bottom surface 42.

The tapered surface 34 is formed at the end 32 opposite the handle 12. The tapered surface 34 extends from the top surface 40 to the bottom surface 42. As such, the bottom surface 42 will have a greater length from the handle 12 than the top surface 40. Specifically, the bottom surface 42 is approximately one-quarter inch longer than the top surface 40. It can be seen that the slot 16 is positioned between the tapered surface 34 and the handle 12.

The dimensions of the present invention are very important so as to facilitate the proper manipulation of the zipper and also for the proper opening of a beverage can. As such, the handle has a length of two and a half inches extending between ends 20 and 22. Similarly, the arm 14 has a length of two and a half inches. The arm has a rectangular cross-section having a width of one-half inch. The slot 16 is positioned approximately one-half inch from the end 32 of the arm 14.

For the purposes of manipulating a zipper, the flap of the zipper is inserted into slot 16. In this position, a force can be applied to the handle 12 so as to move the zipper flap as desired. Ideally, the handle 12 will be positioned in the direction of travel of the zipper flap. However, the proper dimensional arrangements of the present invention facilitate the ability to use the zipper assistance tool 10 with the handle 12 ahead of or behind the direction of travel. After the zipper has been properly manipulated, the slot 16 can be easily pushed away from the zipper flap.

In order to open a beverage can, the end 32 is inserted between the top of the can and the underside of the can tab. By applying a force on the handle 12, the tapered surface 34 will wedge between the top of the can and the tab. The "wedging" action itself will allow the opening of the can. However, to fully open the can, a lifting force should be applied to the handle 12 so as to rotate the tab throughout its desired path of travel.

The tool 10 can be manufactured of a wide variety of materials such as LEXAN (™), plexiglass, LUCITE (™), acrylic, or other materials. The hole 18 can receive a chain or other fastener so that keys can be connected to the tool 10 for convenience.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A tool comprising:

a handle;

an arm connected to and extending transversely to a longitudinal axis of said handle, said arm having a top surface and a bottom surface; and a zipper flap receiving means formed on said arm at an end opposite said handle, said zipper flap receiving means for receiving a zipper flap therein, said zipper flap receiving means comprising a slot formed in said arm and extending parallel to said longitudinal axis of said handle, said slot extending through said arm from said top surface to said bottom surface, said slot having a width of less than one-quarter inch and greater than a thickness of the zipper flap.

2. The tool of claim 1, said handle integrally connected to said arm.

3. The tool of claim 1, said handle being a linear member, said arm having a linear configuration extending from said handle.

4. The tool of claim 1, said arm having a generally rectangular cross-section.

5. The tool of claim 1, said arm having a first side surface and a second side surface, said slot extending into said first side surface.

6. The tool of claim 5, said slot extending into said arm for approximately one-half a width of said top surface and said bottom surface.

7. The tool of claim 1, said arm having a tapered surface formed at said end opposite said handle.

8. The tool of claim 7, said arm having a top surface and a bottom surface, said tapered surface extending from said top surface to said bottom surface, said bottom surface having a greater length from said handle than said top surface.

9. The tool of claim 8, said bottom surface having a length approximately one-quarter inch longer than said top surface.

10. The tool of claim 7, said zipper flap receiving means positioned between said tapered surface and said handle.

11. The tool of claim 1, said handle having a hole extending therethrough.

12. The tool of claim 1, said handle having a length of approximately 2½ inches, said arm having a length of approximately 2½ inches, said zipper flap receiving means positioned approximately ½ inch from said opposite end of said handle.

13. A tool comprising:

a handle;

an arm connected to and extending transversely to a longitudinal axis of said handle, said arm having a top surface and a bottom surface;

a slot formed in said arm adjacent an end of said arm opposite said handle, said slot extending parallel to said longitudinal axis of said handle, said slot extending from said top surface to said bottom surface; and a tapered surface formed at an end of said arm opposite said handle.

14. The tool of claim 13, said arm having a first side surface and a second side surface, said slot extending into said first side surface.

15. The tool of claim 14, said slot having an opening in said first side surface, said opening having a width of less than one-quarter inch.

16. The tool of claim 13, said slot extending into said arm for approximately one-half a width of said top surface and said bottom surface.

17. The tool of claim 13, said tapered surface extending from said top surface to said bottom surface, said bottom surface having a greater length from said handle than said top surface.

18. The tool of claim 17, said bottom surface having a length approximately one-quarter inch longer than said top surface, said slot positioned between said tapered surface and said handle.

19. The tool of claim 13, said handle having a hole extending therethrough.

* * * * *